US005669191A

United States Patent [19]

Weaver

[11] Patent Number: 5,669,191

[45] Date of Patent: Sep. 23, 1997

[54] WINDOW BOARD SYSTEM

[76] Inventor: Randal D. Weaver, 18 Hill St., Ashley, Pa. 18706

[21] Appl. No.: 648,550

[22] Filed: May 15, 1996

[51] Int. Cl.[6] ..... E06B 3/263

[52] U.S. Cl. ..... 52/202; 52/203

[58] Field of Search ..... 52/202, 203, 307, 52/308, 314, 204.62, 204.64, 204.65, 204.66

[56] References Cited

U.S. PATENT DOCUMENTS

| | | | |
|---|---|---|---|
| 4,221,091 | 9/1980 | Ganse et al. | 52/202 |
| 4,263,760 | 4/1981 | Gell | 52/202 X |
| 4,616,456 | 10/1986 | Parker | 52/202 |
| 4,702,051 | 10/1987 | Miller | 52/202 |
| 5,079,886 | 1/1992 | Downs | 52/202 X |
| 5,203,129 | 4/1993 | Johnson | 52/202 |
| 5,560,164 | 10/1996 | Ahrens | 52/202 |

*Primary Examiner*—Wynn E. Wood
*Assistant Examiner*—W. Glenn Edwards

[57] ABSTRACT

A new Window Board system for offering a quick and easy way to insulate and fill a window opening. The inventive device includes an upper window insert end, a lower window insert end, and a compressive spring area. In use, the Window Board System (10) is compressed and fitted into a window frame (16) with the desired message (40) showing in the desired direction. The Window Board System (10) is placed into the window frame (16) when ever one desires to muffle noise, increase insulation value, or block out light. This can be done as often as one chooses, for example, put it in at night and take it out in the morning to make it darker, save on winter heat, and cut down on electrical bills.

9 Claims, 3 Drawing Sheets

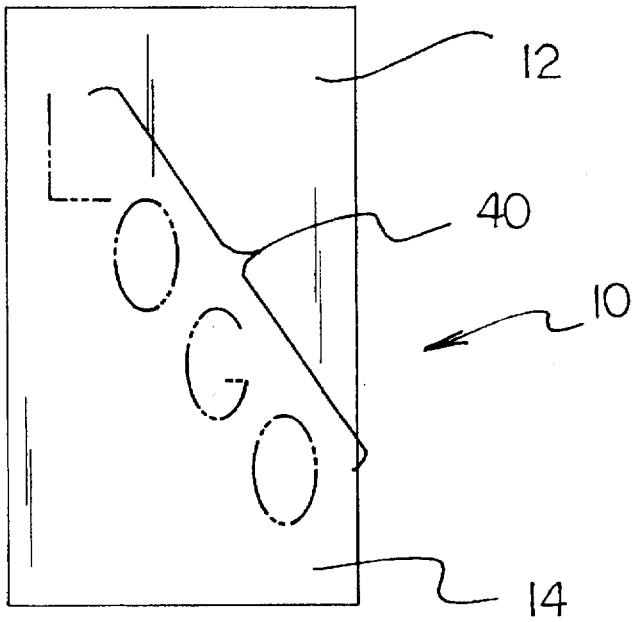
FIG. 5
FIG 7
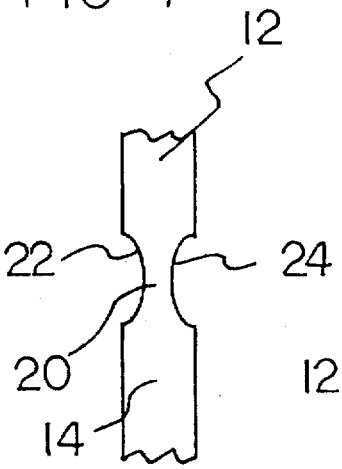
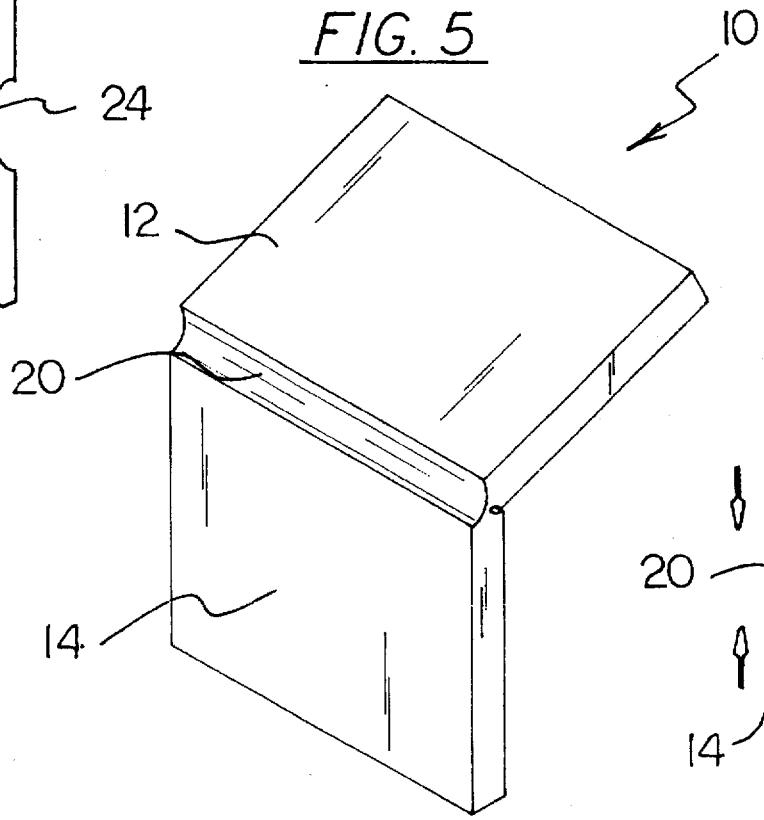
FIG. 6
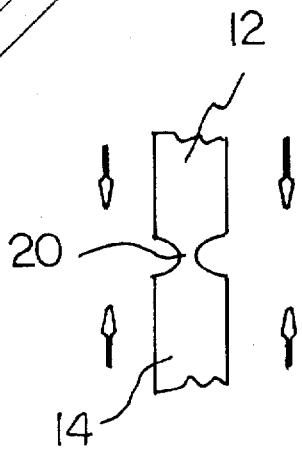
FIG 8

WINDOW BOARD SYSTEM

BACKGROUND OF THE INVENTION

1. Field of the Invention

The present invention relates to window inserts and more particularly pertains to a new Window Board System for offering a quick and easy way to insulate and fill a window opening.

2. Description of the Prior Art

The use of window inserts is known in the prior art. More specifically, window inserts heretofore devised and utilized are known to consist basically of familiar, expected and obvious structural configurations, notwithstanding the myriad of designs encompassed by the crowded prior art which have been developed for the fulfillment of countless objectives and requirements.

Known prior art window inserts include U.S. Pat. No. 4,416,096 issued to Schuster et al. on 22 Nov. 1983; U.S. Pat. No. 5,158,127 issued to Schumacher on 27 Oct. 1992; U.S. Pat. No. 5,203,129 issued to Johnson on 20 Apr. 1993; U.S. Pat. No. Des. 354,358 issued to Wells on 10 Jan. 1995; U.S. Pat. No. 4,450,660 issued to Dean et al. on 29 May 1984, and U.S. Pat. No. 4,272,934 issued to Cowden et al. on 16 June 1981.

While these devices fulfill their respective, particular objectives and requirements, the aforementioned patents do not disclose a new Window Board System. The inventive device includes an upper window insert end, a lower window insert end, and a compressive spring area.

In these respects, the Window Board System according to the present invention substantially departs from the conventional concepts and designs of the prior art, and in so doing provides an apparatus primarily developed for the purpose of offering a quick and easy way to insulate and fill a window opening.

SUMMARY OF THE INVENTION

In view of the foregoing disadvantages inherent in the known types of window inserts now present in the prior art, the present invention provides a new Window Board System construction wherein the same can be utilized for offering a quick and easy way to insulate and fill a window opening.

The general purpose of the present invention, which will be described subsequently in greater detail, is to provide a new Window Board System apparatus and method which has many of the advantages of the window inserts mentioned heretofore and many novel features that result in a new Window Board System which is not anticipated, rendered obvious, suggested, or even implied by any of the prior art window inserts, either alone or in any combination thereof.

To attain this, the present invention generally comprises an upper window insert end, a lower window insert end, and a compressive spring area.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Window Board System apparatus and method which has many of the advantages of the window inserts mentioned heretofore and many novel features that result in a new Window Board System which is not anticipated, rendered obvious, suggested, or even implied by any of the prior art window inserts, either alone or in any combination thereof.

It is another object of the present invention to provide a new Window Board System which may be easily and efficiently manufactured and marketed.

It is a further object of the present invention to provide a new Window Board System which is of a durable and reliable construction.

An even further object of tile present invention is to provide a new Window Board System which is susceptible of a low cost of manufacture with regard to both materials and labor, and which accordingly is then susceptible of low prices of sale to the consuming public, thereby making such Window Board System economically available to the buying public.

Still yet another object of the present invention is to provide a new Window Board System which provides in the apparatuses and methods of the prior art some of tile advantages thereof, while simultaneously overcoming some of the disadvantages normally associated therewith.

Still another object of the present invention is to provide a new Window Board System for offering a quick and easy way to insulate and fill a window opening.

Yet another object of the present invention is to provide a new Window Board System which includes an upper window insert end, a lower window insert end, and a compressive spring area.

Still yet another object of the present invention is to provide a new Window Board System that makes it more tolerable for those living near airports, oceans, highways, and railroads.

Even still another object of tile present invention is to provide a new Window Board System that aids in saving on heating expenses.

These together with other objects of tile invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a front side elevation view of the present invention.

FIG. 6 is a right side perspective view of the present invention illustrating a compressive spring area.

FIG. 7 is an enlarged detail side view of the compressive spring area.

FIG. 8 is an enlarged detail side view of the compressive spring area illustrating the compressive action.

DESCRIPTION OF THE PREFERRED EMBODIMENT

Figure 1:
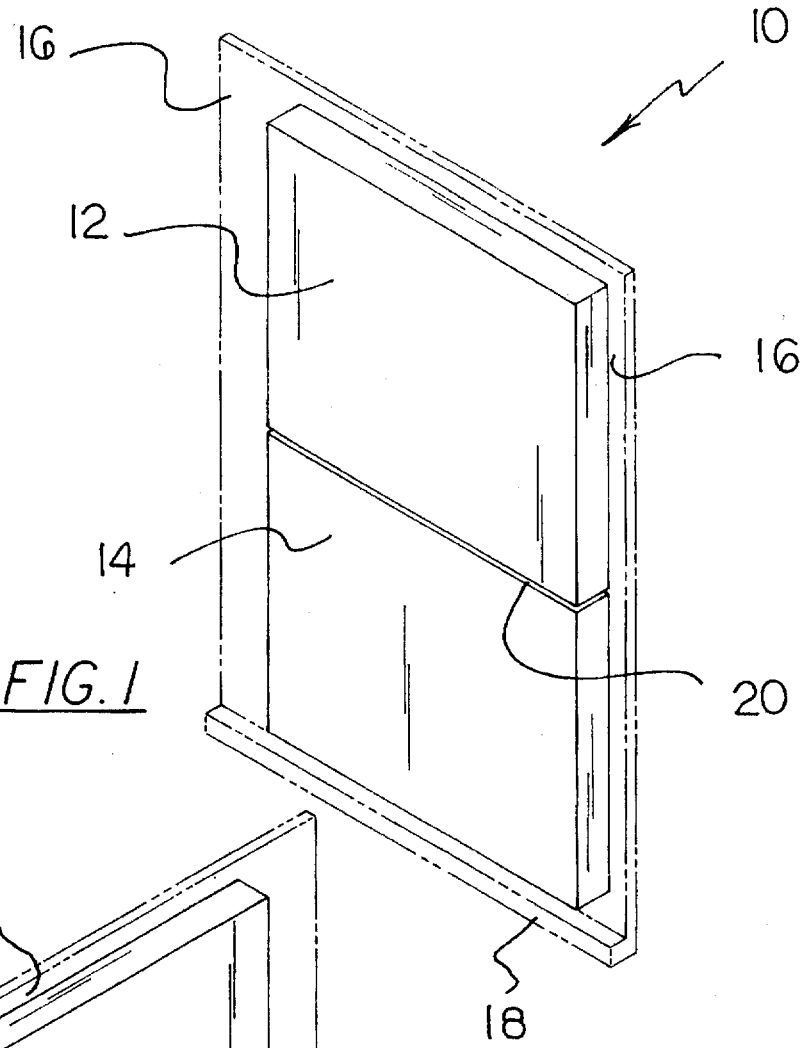
FIG. 1 is a right side perspective view of a new Window Board System according to the present invention installed into a window frame.
Figure 2:
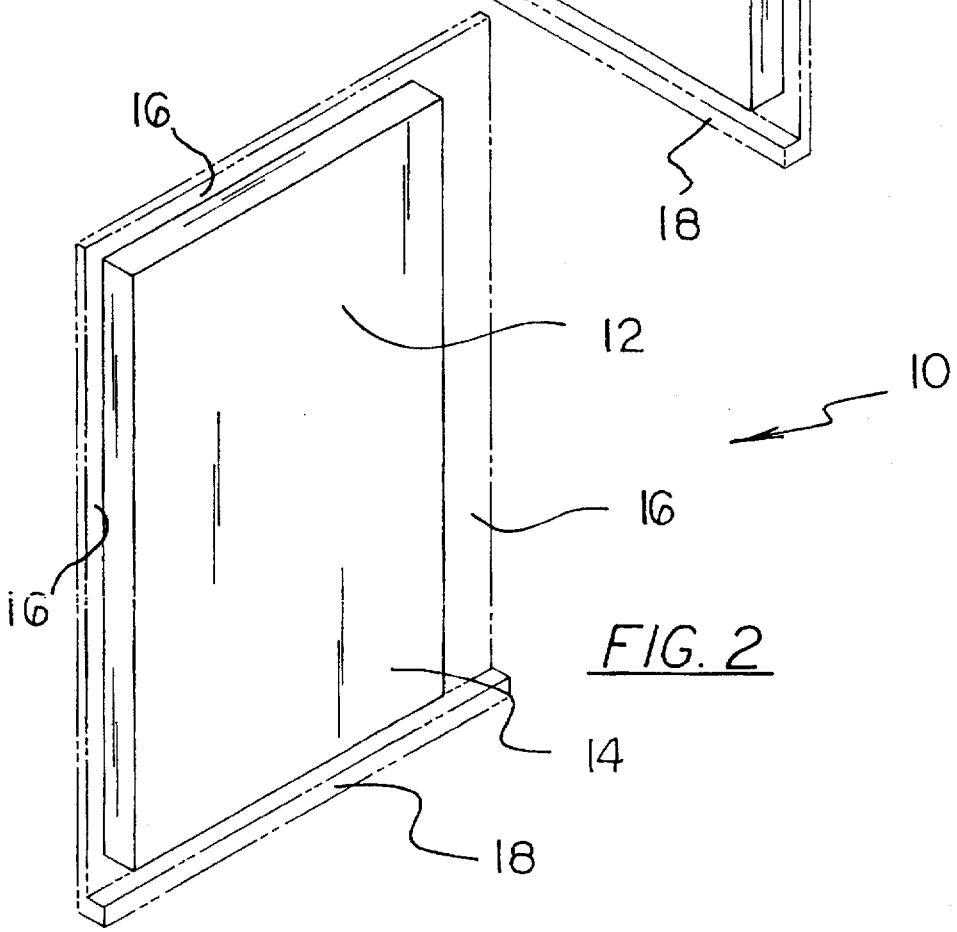
FIG. 2 is a left side perspective view of another embodiment of the present invention installed into a window frame.
Figure 3:
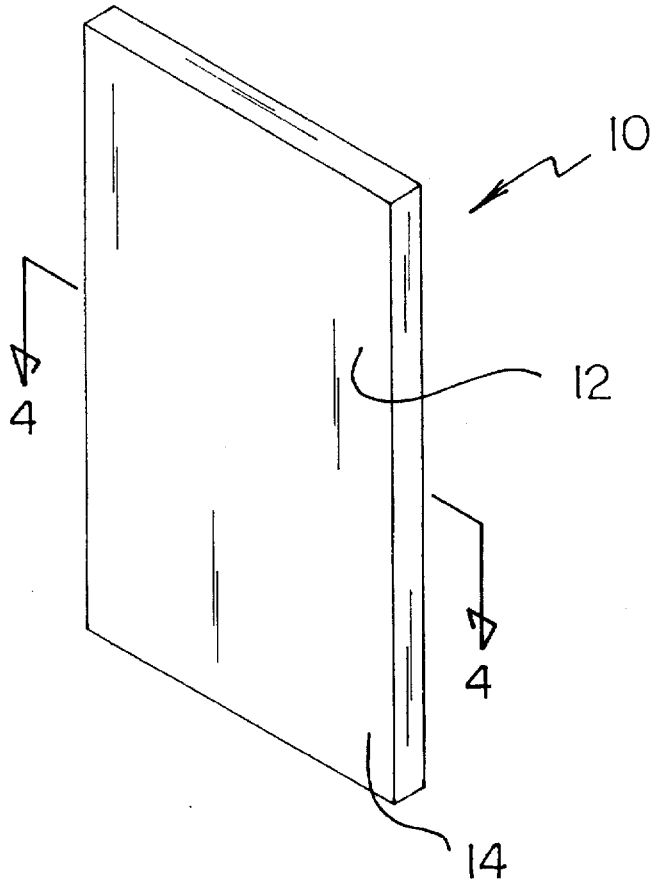
FIG. 3 is a right side perspective of the present invention.

With reference now to the drawings, and in particular to FIGS. 1 through 6 thereof, a new Window Board System embodying the principles and concepts of the present invention and generally designated by the reference numeral 10 will be described.

More specifically, it will be noted that the Window Board System 10 comprises an upper window insert end 12, a lower window insert end 14, and a compressive spring area 20.

As best illustrated in FIGS. 1 through 6, it can be shown that the upper window insert end 12 and the lower window insert end 14 are integral with each other and are placed within a window frame 16 and sit upon a window sill 18.

Figure 4:
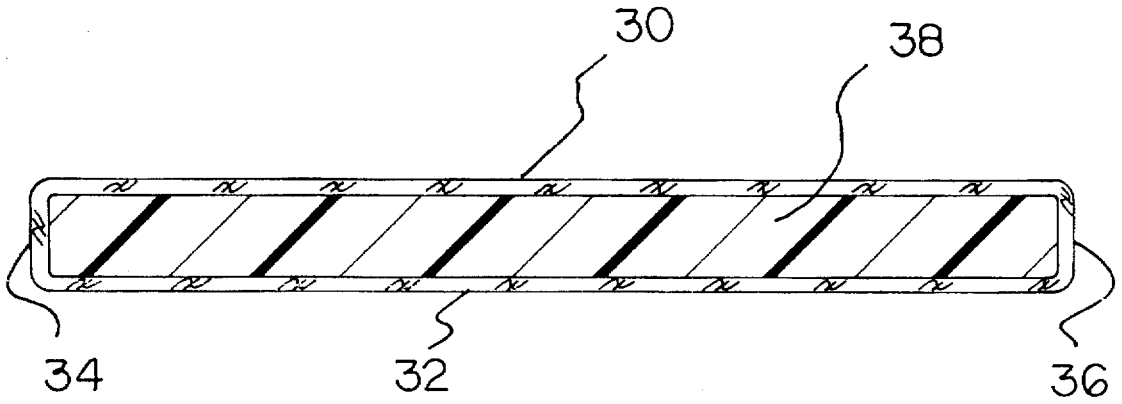
FIG. 4 is a cross sectional view taken along line 4—4 of FIG.

Referring to FIG. 4, it can be shown that the Window Board System 10 is preferably constructed by providing a first wall 30 and a second wall 32 held in spaced apart relationship by one side wall 34 and another side wall 36 and an insulation medium 38.

Referring to FIG. 5, the first wall 30, and the second wall 32 further include a message 40 and are generally made of an off-white color to enhance reflective illumination. Other colors of choice can be used as well.

In a preferred embodiment of the invention, referring to figures 6, 7, and 8, the upper window insert end 12 and the lower window insert end 14 can be connected by a compressive spring area 20. The compressive spring area 20 is comprised of a first concave groove 22 which connects the first wall 30 of the upper window insert end 12 to the first wall 30 of the lower window insert end 14, and a second concave groove 24 which connects the second wall 32 of the upper window insert end 12 to the second wall 32 of the lower window insert end 14. The first concave groove 22 and the second concave groove 24 are opposed from each other and held in spaced apart relationship by one side wall 34 and another side wall 36 and an insulation medium 38.

In use, the Window Board System 10 is compressed and fitted into a window frame 16 with the desired message 40 showing in the desired direction. The Window Board System 10 is placed into the window frame 16 when ever one desires to muffle noise, increase insulation value, or block out light. This can be done as often as one chooses, for example, put it in at night and take it out in the mourning to make it darker, save on winter heat, and cut down on electrical bills.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Window Board System for covering the window panes of a window having lateral window frame surfaces being oriented substantially perpendicular to said window panes and defining a perimeter for said window, comprising:

an upper window insert panel for covering an upper portion of a window, a lower window insert panel for covering a lower portion of a window, and an integral compressive spring area oriented between and connecting said upper and lower window insert panels together, wherein said compressive spring area has relatively less resistance to compression than said upper and lower window insert panels to thereby cause said upper and lower window insert panels to apply outward spring force against the window frame surfaces of a window when said compressive spring area is compressed between said upper and lower window insert panels to thereby hold the upper and lower window insert panels in place adjacent to the window panes of said window.

2. The Window Board System of claim 1, wherein the upper window insert panel, the lower window insert panel and the compressive spring area are formed of a single unitary piece.

3. The Window Board System of claim 1, wherein said upper and lower window insert panels each comprise a first wall and a second wall in a spaced relationship with an insulation medium interposed therebetween.

4. The Window Board System of claim 3, wherein the insulation medium has sound deadening properties and heat resistance properties.

5. The Window Board System of claim 3, wherein the first and second walls are made of a light reflective material.

6. The Window Board System of claim 3, wherein at least one of said walls has a message printed thereon and has an off-white color to enhance reflective illumination.

7. The Window Board System of claim 1, wherein the upper window insert panel has an upper end edge and the lower window insert panel has a lower end edge, wherein each said window insert panel has substantially the same area size such that said compressive spring area is located at a medial location between said end edges of the window insert panels oriented parallel to said compressive spring area.

8. The Window Board System of claim 1, wherein the upper insert panel comprises a first and second wall, and the lower insert panel comprises a first and second wall;

the compressive spring area comprises a first concave groove connecting the first wall of the upper window insert panel to the first wall of the lower window insert panel;

a second concave connecting the second wall of the upper window insert panel to the second wall of the lower window insert panel; and where said first concave groove and the second concave groove are substantially opposed from each other and spaced apart from each other by an insulation medium.

9. The window board system of claim 1 wherein the upper and lower window insert panels and the compressive spring area comprise and insulating medium, and wherein the compressive spring area comprises an area of reduced insulating medium thickness relative to the thickness of the insulating medium of said upper and lower window insert panels to permit said compressive spring area to function as a flexible hinge between said window insert panels such that one said window insert panel may be positioned at an angle to the other said window insert panel when mounting said window board system on a window.

* * * * *